US005535687A

United States Patent [19]

Khanna

[11] Patent Number: 5,535,687

[45] Date of Patent: Jul. 16, 1996

[54] CIRCULATING FLUIDIZED BED REPOWERING TO REDUCE SOX AND NOX EMISSIONS FROM INDUSTRIAL AND UTILITY BOILERS

[75] Inventor: Ramesh D. Khanna, Chicago, Ill.

[73] Assignee: Raytheon Engineers & Constructors, Lexington, Mass.

[21] Appl. No.: 296,233

[22] Filed: Aug. 25, 1994

[51] Int. Cl.[6] ..... F23J 11/00

[52] U.S. Cl. ..... 110/345; 60/645; 110/245; 122/40

[58] Field of Search ..... 122/40; 110/245, 110/345; 60/645

[56] References Cited

U.S. PATENT DOCUMENTS

| | | | |
|---|---|---|---|
| 4,103,646 | 8/1978 | Yerushalmi et al. | 122/4 D |
| 4,173,950 | 11/1979 | Waryasz | 122/4 D |
| 4,249,377 | 12/1980 | Johnson | 122/4 D |
| 4,309,393 | 1/1982 | Nguyen | 110/345 |
| 4,380,154 | 4/1983 | Eastman | 60/682 |
| 4,616,576 | 10/1986 | Engstrom et al. | 60/682 |
| 4,681,065 | 7/1987 | Bergkvist | 110/345 |
| 4,765,258 | 8/1988 | Zauderer | 122/4 D |
| 4,796,568 | 1/1989 | Pillai | 110/245 |
| 4,815,418 | 3/1989 | Maeda et al. | 122/4 D |
| 4,936,047 | 6/1990 | Feldmann et al. | 122/4 D |
| 4,974,411 | 12/1990 | Bruckner et al. | 122/4 D |
| 4,993,332 | 2/1991 | Boross et al. | 122/4 D |
| 5,029,557 | 7/1991 | Korenberg | 110/245 |
| 5,033,413 | 7/1991 | Zenz et al. | 122/149 |
| 5,069,685 | 12/1991 | Bissett et al. | 122/4 D |
| 5,084,258 | 1/1992 | Ping-Wha Lin | 423/244 |
| 5,112,588 | 5/1992 | Staudinger et al. | 423/244 |

*Primary Examiner*—Noah P. Kamen

[57] ABSTRACT

Repowering industrial and utility boilers with a circulating fluidized bed combustor to reduce SOx and NOx emissions emanating from the boilers by the following steps.

First combusting high sulfur-containing carbonaceous solid fuel in a circulating fluidized bed combustor in admixture with limestone and air.

Secondly combusting a carbonaceous fuel in an industrial or utility boiler.

Thirdly mixing the flue gases generated in the circulating fluidized bed combustor with the exhaust gases produced in the industrial or utility boiler.

Finally controlling the total heat generation by maintaining the circulating fluidized bed heat input to the boiler furnace from about 70 to 90% and the heat input of the boiler furnace from about 30 to 10%.

8 Claims, 4 Drawing Sheets

CIRCULATING FLUIDIZED BED REPOWERING TO REDUCE SOX AND NOX EMISSIONS FROM INDUSTRIAL AND UTILITY BOILERS

BACKGROUND OF THE INVENTION

1. Field of the Invention

This invention relates generally to methods and apparatus for power generation while reducing emission of industrial pollution during such power generation. More particularly, the invention relates to a process and apparatus for: burning carbonaceous materials and especially high sulfur-containing coal and low grade carbonaceous material under essentially stoichiometric conditions in a circulating fluidized bed combustor; reducing SOx and NOx emissions from industrial and utility boilers; and repowering cyclone-fired boilers, pulverized coal-fired boilers and oil and gas-fired boilers. The invention provides means to comply with air pollution standards without excessive capital expenditures.

2. Reported Developments

Fossil fuel-fired boilers utilized in the industry today are complex heat exchange apparatuses, the basic function of which is to convert water into steam for electricity generation and process applications. Coal, ranging from lignite having low BTU values to high-rank coals, such as anthracite, is typically used in these boilers, it being abundant and relatively inexpensive. The physicochemical aspects of coal combustion are complex and depend on parameters such as the coal's elemental composition and the apparatus in which the combustion occurs. For example, low-rank coals having lower BTU values are easier to ignite than high-rank coals; however, low rank coals have a higher moisture content which inhibits combustion and consumes useful heat. The overall heat balance for coal combustion reactions also involves such factors as particle size, surface area, pore structure, volatile matter content, additives and impurities of the coal.

The combustion process in generating power for electricity and other uses also generates undesired products carried in the effluent gases, such as NOx and SOx. Prior art combustion systems are directed to reducing such emissions into the atmosphere while increasing the usable heat values extracted from the coal. The systems in use for most commercial applications of coal combustion are fixed-bed, entrained flow and fluidized bed combustors.

Fixed-bed combustion is characterized as being either up-draught or down-draught combustion both utilizing sized coal particles. In an up-draught configuration the primary air source is at or slightly below the level of the fuel. The fuel is ignited at the bottom and the flame travels upward with the air flow. A secondary air inlet is positioned above the level of the bed to facilitate combustion of volatiles emanating from the bed prior to being combusted. Smoke, containing incompletely combusted volatiles, including harmful pollutants, easily escapes from this system. In the down-draught configuration, the air flows downward onto the fuel bed and the flame front moves counter to the direction of the air and the emanating volatiles are kept in the flame by the air steam. This system achieves a more complete combustion and reduction of pollution than the up-draught configuration.

The entrained flow combustor system utilizes finely pulverized coal and a high velocity carrier, such as air or other gases, to suspend the finely divided coal particles. The operating temperatures are as high as 1400° to 1700° C. The release of heat is greater than that produced by the fixed bed or fluidized bed systems, however, the drawbacks are corrosion problems and high nitrogen oxide emissions.

The fluidized bed process uses sized coal particles which are caused to float in an upward stream of gas. The process uses low operating temperatures in the range of approximately 1500° to 1700° F. which reduces the emission of nitrogen oxides. Efficient combustion can be achieved at this temperature and with as little as one to five percent coal feed. This low coal feed also allows the addition of materials which can greatly reduce emission of other pollutants. Limestone ($CaCO_3$) or dolomite ($CaCO_3$-$MgCO_3$) are, therefore, used in fluidized bed reactors to remove sulfur pollutants by forming calcium or magnesium sulfates from $SO_2$ released during combustion. Recovery and recycling of the calcium or magnesium can be achieved by treatment of the sulfates with $H_2$ or CO to produce sulfur dioxide which is not fugitive and can be used for sulfuric acid manufacture and recovery of elemental sulfur. Loss of fines, however, occurs during fluidized bed combustion and must be controlled with cyclones or electrostatic precipitators incorporated into the system.

Fluidized bed systems are usually classified in terms of: operating pressure, namely atmospheric or pressurized, and fluidization mode, namely bubbling or circulating. The circulating fluidized bed system exhibits higher combustion efficiency and sorbent utilization, lower NOx emission due to multiple air staging and greater fuel flexibility as compared to a bubbling type system. Such a circulating fluidized bed boiler is disclosed, for example, in U.S. Pat. No. 5,255,507. Briefly described, the circulating fluidized bed (hereinafter sometimes referred to as CFB) combustor comprises: a combustion chamber into which a combustible material, such as coal, noncombustible material, such as limestone and primary and secondary air are fed. These materials are maintained in a fluidized state by controlling the bed material and flow of air. The combustion chamber is defined by combustion walls having membrane type tubes incorporated therein to contain circulating water. The water is heated in these tubes to produce steam which, after having been subjected to means to increase its temperature, such as a superheater, is directed to a steam turbine. The steam turbine is connected to an electric generator to produce electric power. The hot combustion output is carried from the combustion chamber to a hot cyclone separator in which the solid particles are separated from the flue gasses and returned to the bottom of the combustion chamber for recirculation.

In power generation for various industrial uses a main objective is to reduce the amount of pollution released into the atmosphere or ash discarded into the environment while achieving high temperatures necessary to the operation of fuel-driven turbines and the like power generating systems. The main atmospheric pollutants incident to power generation are oxides of nitrogen (NOx) and oxides of sulfur (SOx). The oxides of nitrogen are mostly nitric oxide (NO) and nitrogen dioxide ($NO_2$).

NOx emissions from stack gases through reactions occurring in the air produce smog and contribute to the formation of acid rain. State and federal agencies have been and are setting increasingly stricter limits on the amounts of oxides of nitrogen that can be vented to the atmosphere. To comply with state and federal standards various methods were tried and proposed by the prior art. These methods included, for example, injecting water into the combustion zone to lower the flame temperature and retard the formation of NOx which increases with increasing temperatures; and injecting ammonia and a reducing catalyst to achieve a similar reduction in NOx formation.

To suppress sulfur dioxide generated during combustion of carbonaceous fuel, such as coal and leachable sulfur in the ash residue of combustion, coal is mixed with a sulfur absorbent such as calcium oxide, calcium hydroxide or calcium carbonate prior to combustion or gasification. To achieve satisfactory sulfur capture, the combustion temperature, however, has to be maintained at less than about 1700° F.

To wit, the reduction/elimination of pollutants require the use of relatively low temperature combustion, while efficient power generation requires the generation of high temperatures.

Examples of prior art disclosures trying to satisfy both requirements follow.

U.S. Pat. No. 4,103,646, discloses a fluid bed boiler having two zones: in the first zone coal and limestone are fed, fluidized by air at high velocities and combusted to capture sulfur dioxide; the solids exiting from the first zone is lead into the second, slow bubbling bed zone fluidized by low velocity air. Solids remaining in the slow bed are recirculated back into the first zone. The second zone contains heat exchangers.

U.S. Pat. No. 4,616,576 relates to a two-stage combustion method utilizing first and second circulating fluidized bed systems.

Fuel is supplied to the first circulating fluidized bed system and is combusted therein under reducing conditions of 700° to 1000° C. Solid material is separated from the gases discharged from the first circulating fluidized bed system and recirculated into the first fluidizing bed system. The flue gases are fed into the second circulating fluidized bed system, which contains a sulfur-absorbing agent, such as lime, to effect after burning and to reduce NOx formation.

U.S. Pat. No. 5,156,099 discloses a modified circulating fluidized bed boiler, termed internal recycling type fluidized bed boiler, in which the fluidized bed portion of the boiler is divided by a partition into a primary combustion chamber and a thermal energy recovery chamber. Two kinds of air supply chambers are provided below the primary combustion chamber: one for imparting a high fluidizing speed to a fluidizing medium; and the other for imparting a low fluidizing speed to the fluidizing medium, thereby providing a whirling and circulating flow to the fluidizing medium in the combustion chamber. Exhaust gas is lead to a cyclone and fine particulates collected at the cyclone is returned into the primary combustion chamber or in the thermal chamber.

U.S. Pat. No. 4,936,047 discloses a method for reducing the amount of gaseous sulfur compounds released during combustion of sulfur-containing fuel comprising: mixing the fuel with an aqueous solution of calcium-containing sulfur absorbent; exposing the mixture in a reactor to a reducing atmosphere at a temperature range of 1500° F. to 1800° F. for converting at least 20% of the solid carbonaceous material to the gaseous state while forming a solid char material; and passing the solid char material into a combustor and combusting the char at a temperature of at least 2100° F. in the presence of oxygen to promote the reaction of sulfur to form calcium sulfate.

U.S. Pat. No. 5,178,101 pertains to a method for reducing oxides of nitrogen that are generated in a coal-fired fluidized bed boiler comprising the steps off flowing an exhaust stream from the fluidized bed boiler generated at a temperature of about 600° to 650° F. through a thermal reaction zone at which fuel and air are burned to produce a modified heated stream;

passing the modified heated stream over a first catalyst bed to oxidize $N_2O$ and NOx to $NO_2$;

cooling the exhaust stream; and passing the cooled stream over an oxidizing catalyst bed to oxidize remaining combustibles.

While the prior art have made significant advances in reducing environmentally harmful pollutants during combustion of carbonaceous fuel to generate power, there is still a need for further improvements in pollution reduction and power generation. The present invention is directed to such improvements as described more particularly in the objects of the present invention that follows.

It is an object of the present invention to provide a method for enhancing sulfur capture by sulfur absorbents during the combustion of particulate fuel.

It is another object of the present invention to provide a method to reduce oxides of nitrogen generated during the combustion of carbonaceous fuel.

It is still another object of the present invention to generate power at high efficiency, which is accomplished by methods directed to repowering: cyclone-fired boilers, pulverized coal-fired boilers, gas- and oil-fired boilers; and boilers having conventional radiant furnaces.

A still further object of the present invention is to provide a system for attaining these objects.

SUMMARY OF THE INVENTION

To achieve the foregoing objects, in accordance with the present invention, there is provided a system for repowering industrial and utility boilers with a circulating fluidized bed combustor to reduce SOx and NOx emission from industrial and utility boilers.

The system comprises:

a circulating fluidized bed combustor;

a hot cyclone separator; and a radiant boiler, or a cyclone fired boiler or a coal-, oil- or gas-fired boiler (hereinafter sometimes referred to as "boiler" to mean any of the boilers listed).

The circulating fluidized bed combustor and the boilers also comprise heat exchangers in which steam is generated, mixed and then superheated in a primary and secondary superheater from which the superheated steam is led to power an electric turbine.

The circulating fluidized bed combustor is provided for combusting a carbonaceous solid fuel, such as high sulfur-containing coal. Carbonaceous solid fuel, limestone and air are fed into the circulating fluidized bed to combust the carbonaceous solid fuel at a controlled temperature of from about 1500° F. to 1700° F., and preferably at about 1600° F. The combustion produces a heated exhaust which contains greatly reduced amounts of SOx and NOx for the reason of low temperature combustion and the presence of limestone in the circulating fluidized bed. The circulating fluidized bed is equipped with a heat exchanger containing water so that the combustion of the carbonaceous solid fuel produces saturated steam therein.

The combustion exhaust from the fluidized bed combustor is led into a particulate separator, i.e. hot cyclone separator to separate flue gases from solid particulates. The solid particulates are removed and fed back to the circulating fluidized bed combustor for further combustion and recirculation.

A boiler to combust carbonaceous fuel, such as coal, oil or gas is constructed with a series of partition walls formed of tubes serving as heat exchangers is also provided. The combustion of the carbonaceous fuel will produce a combustion exhaust in the boiler chamber and saturated steam in the heat exchangers.

The boiler will receive the flue gases separated in the hot cyclone separator by way of a conduit. The flue gases from the hot cyclone separator and the combustion exhaust generated in the boiler are mixed in the boiler chamber so that:

all of the flue gases from the CFB combustor will be mixed with all of the combustion exhaust from the boiler. In addition, heat input is controlled so that:

70 to 90% of heat input is from CFB combustor; and 30 to 10% of heat input is from the boiler.

The boiler operates at low loads which results in low burner zone heat release rates and low thermal NOx.

The saturated steam generated in the heat exchanger of the CFB combustor is mixed with the saturated steam generated in the heat exchangers of the boiler. The mixing is accomplished at the primary superheater inlet header of the boiler.

The superheated steam from the primary superheater is led to a secondary superheater which is located in the heat exchanger of the circulating fluid bed. There the steam is further superheated before it being led to the steam turbine.

The present invention further provides a process for repowering industrial and utility boilers with a circulating fluidized bed combustor to reduce SOx and NOx emissions from industrial and utility boilers. The process comprising the steps of:

(a) feeding a carbonaceous solid fuel (such as high sulfur-containing, low grade coal) air and limestone into a circulating fluidized bed combustor which comprises a combustion chamber and a heat exchanger (I) containing water therein;

(b) firing the low grade solid fuel in the presence of the limestone and operating said circulating fluidized bed at a temperature of about 1600° F. to produce heat and exhaust gases containing solid particulates whereby:

(1) the carbonaceous solid fuel undergoes combustion and the limestone provides for capture of SOx which results from the oxidation of the sulfur;

(2) the low heat release at about 1600° F. results in low thermal NOx; and (3) saturated steam is produced in heat exchanger (I);

(c) separating flue gases from the solid particulates (produced in step b) using a particulate separator, such as a hot cyclone separator;

(d) feeding the solid separated particulates back into the fluidized bed combustor for further combustion and recirculation;

(e) feeding a mixture of a carbonaceous fuel (such as coal, oil or gas) and air into a boiler furnace (adjacent to, but separate from said fluidized bed combustor) said boiler furnace comprising: a combustion chamber and a heat exchanger (II) containing water therein;

(f) burning the mixture to generate exhaust gases in the combustion chamber and producing saturated steam in heat exchanger (II);

(g) leading flue gases separated from solid particulates in step (c) into the combustion chamber of the boiler furnace and mixing the flue gases with the exhaust gases generated in the combustion chamber of the boiler furnace to form a mixture of gases comprising: all of the flue gases generated in the circulating fluidized bed combustor; and all of the exhaust gases generated in the combustion chamber of the boiler furnace;

(h) controlling the total heat generation by maintaining the circulating fluidized bed heat input to the boiler furnace at about 70 to 90% and the heat input of the boiler furnace at about 30 to 10%;

(i) leading the saturated steam produced in heat exchanger (I) in step (b) and mixing it with the saturated steam produced in heat exchanger (II) in step (f);

(j) leading the mixed saturated steam into primary superheater located at the inlet header of the boiler furnace to produce a superheated steam;

(k) leading the superheated steam to a secondary superheater or reheater located in heat exchanger (I) which secondary heat exchanger may be an integral part or external component of the circulating fluidized bed combustor;

(l) reheating the superheated steam in the secondary heat exchanger; and (m) leading the superheated steam to an inlet in a steam turbine to provide power for generating electricity.

Figure 1:
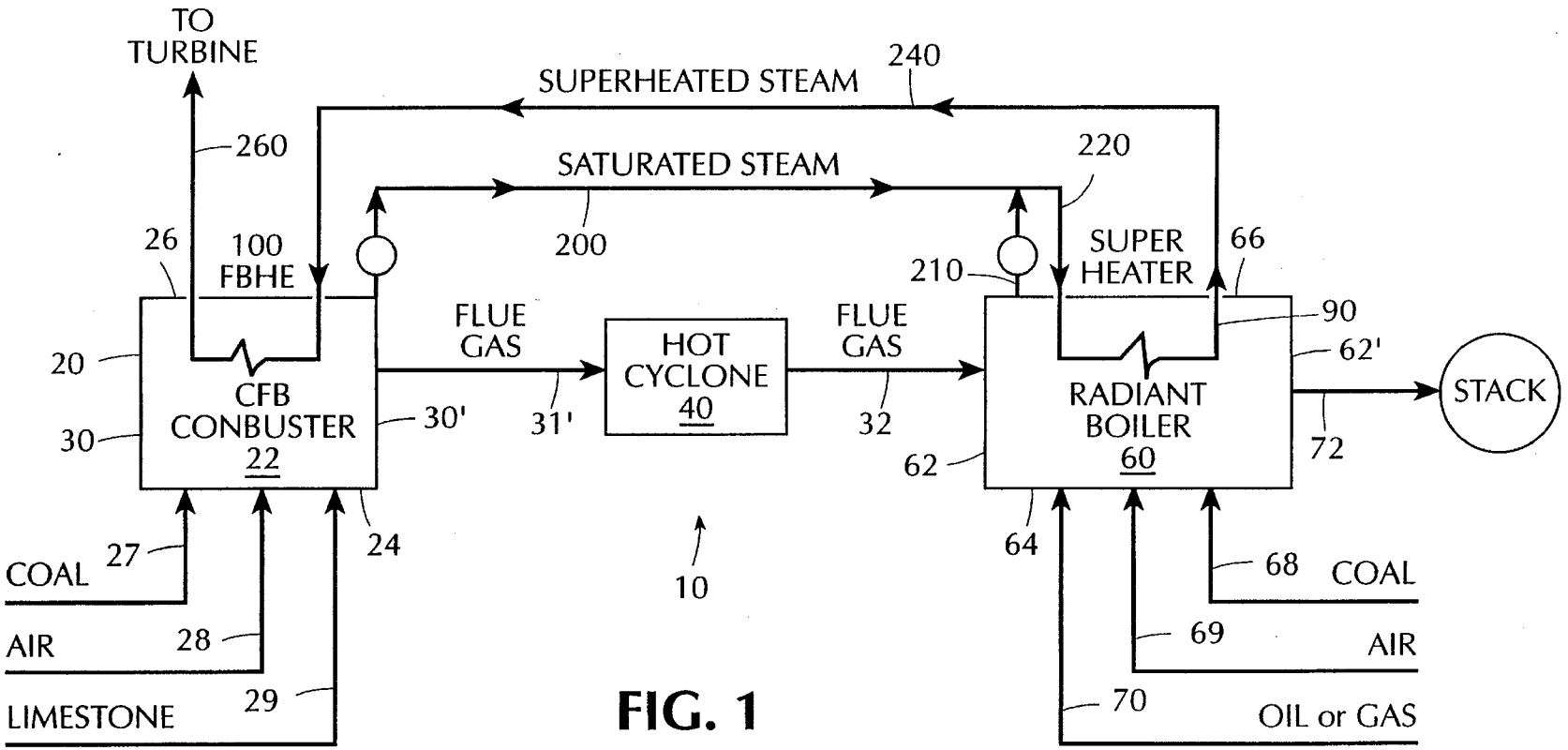
FIG. 1 is a schematic representation of the circulating fluidized bed repowering of a radiant boiler.

| PARTS LIST | |
|---|---|
| System of repowering industrial and utility boilers (generally) | 10 |
| Fluidized bed combustor | 20 |
| Fluidized bed combustion chamber | 22 |
| Bottom combustion wall of fluidized bed combustion chamber | 24 |
| Side combustion wall of fluidized bed combustion chamber | 30 & 30' |
| Top combustion wall of fluidized bed combustion chamber | 26 |
| Coal inlet to combustion chamber | 27 |
| Air inlet to combustion chamber | 28 |
| Limestone inlet to combustion chamber | 29 |
| Conduit from combustion chamber to hot cyclone | 31 |
| Hot cyclone | 40 |
| Conduit from hot cyclone to radiant boiler | 32 |
| Radiant boiler | 60 |
| Bottom wall of radiant boiler | 64 |
| Side walls of radiant boiler | 62 & 62' |
| Top wall of radiant boiler | 66 |
| Coal inlet to radiant boiler | 68 |
| Air inlet to radiant boiler | 69 |
| Oil or gas inlet to radiant boiler | 70 |
| Stack | 72 |
| Fluid bed heat exchanger or secondary superheater (FBHE) | 100 |
| Heat exchanger fluid line (carries steam from CFB combustor 20) | 200 |
| Heat exchanger fluid line (carries steam from radiant boiler 60) | 210 |
| Primary superheater associated with radiant boiler | 90 |
| Heat exchanger fluid line (for mixed steam) | 220 |
| Supply line for superheated steam to FBHE (100) | 240 |
| Supply line for superheated steam from FBHE (100) to steam turbine | 260 |
| Heat exchanger (I) in CFB combustor | 80 |
| Heat exchanger (II) in radiant boiler or furnace | 82 |

DETAILED DESCRIPTION OF THE INVENTION

Referring now to the drawings, the system of repowering industrial and utility boilers, (hereinafter sometimes referred to as "power plant") designated generally by the numeral 10, is shown schematically in FIG. 1. The power plant 10 comprises a circulating fluidized bed combustor 20 (hereinafter sometimes referred to as "CFB"), having a combustion chamber 22, which is defined by bottom combustion wall 24, side combustion walls 30 and 30' and top combustion wall 26. The combustion chamber is of cylindrical configuration utilized by the prior art, although other suitable configurations may also be used, and constructed with tube walls which serve as heat exchangers, and which are preferably covered with refractory covering. Carbonaceous solid fuel, such as high sulfur-containing coal, air and limestone are fed into combustion chamber 22 through bottom combustion wall 24, by way of inlets 27, 28 and 29 respectively. In the combustion chamber the carbonaceous material is combusted while the bed is maintained in a fluidized state by the proper balance of the carbonaceous fuel, air and limestone. The combustion chamber 22 is operated at a temperature of about 1500° F. to 1700° F. and preferably at about 1600° F. This low combustion temperature reduces the quantities of oxides of nitrogen (NOx) including $N_2O$ generated during combustion. Operating the combustion chamber at this temperature also facilitates the chemical reaction between CaO present in limestone and SOx contaminants present in the carbonaceous fuel. The conditions maintained in the combustion chamber renders the operation substoichiometric, i.e. the air introduced into the combustion chamber provides less oxygen than is necessary for complete combustion of the carbonaceous fuel. The fuel not having been completely burned, a reducing atmosphere is created which produces less nitrogen oxides than that which would be generated with the use of surplus oxygen. Combustion gas rises above the fluidized bed carrying fine particulate matter, such as calcium sulfate, unburned fuel and the like constituting the exhaust of the combustion process. The combustion exhaust emanating from combustion chamber 22 is led by conduit 31 to a hot cyclone 40. In the hot cyclone 40 the solid particulates are separated and are removed from the exhaust gases. The solid particulates may be returned to combustion chamber 22, for example, by way of inlets 27, 28 or 29 for further combustion and recirculation or they may be withdrawn from the hot cyclone by other means (not shown). As a result of the use of the hot cyclone, the flue gases leaving the hot cyclone are close to being free of solid particulates. Flue gases from the hot cyclone 40 is led by way of conduit 32 into radiant boiler 60.

Radiant boiler 60 comprises bottom wall 64, side walls 62 and 62' and top wall 66. Bottom wall contains inlets 68, 69 and 70 through which coal, air and oil or gas is respectively introduced for the operation of the radiant boiler. Conduit 72 represents the stack through which exhaust is released into the atmosphere. Radiant boiler 60 is constructed with a series of partition walls formed of tubes (not shown) spaced at intervals and serving as heat exchange means containing a heat exchange fluid therein.

Radiant boiler 60 combusts a mixture of coal and air, oil and air, gas and air or a combination thereof. Radiant boiler 60 will also generate exhaust gases which will be mixed above its burners with flue gases led into the radiant boiler from hot cyclone 40 through conduit 32: all of the flue gases that originate from the CFB combustor, and all of the exhaust gases that originate from the radiant boiler. Accordingly, 100% of the mixed gases flow through the radiant boiler. Furthermore, the CFB combustor 20 and radiant boiler 60 are operated under strict control of fuel load, proper mixture of input of fuel and air so that the following heat input is maintained:

heat input from CFB combustor is 70 to 90%; and heat input from radiant boiler is 30 to 10%.

As referred to earlier, significant NOx reduction occurs in the CFB combustor since it operates at the low temperature range of from about 1500° F. to 1700° F. The radiant boiler is operated at higher temperatures in the range of from about 2000° to 2600° F. Heat and flue gas input from the radiant boiler is low by operating it at low loads which leads to low burner zone heat release rates and low thermal NOx. Exhaust from radiant boiler will exit to the atmosphere, after it has been cooled, through stack 72.

The temperature of the mixed flue gases leaving the radiant boiler is reduced because of the low combustion temperature of coal in the CFB combustor. To compensate for the low temperature, primary superheater 90, and fluid bed heat exchanger (FBHE) 100, (also referred to in FIGS. 2, 3 and 4 as "secondary superheater") are used to increase the temperature of the steam heated in the heat exchangers of the CFB combustor and the radiant boiler.

Turning now to steam generation and still referring to FIG. 1, CFB combustor is equipped with heat exchanger (not shown but referred to in FIGS. 2, 3 and 4 as 80) circulating therein a heat exchange fluid. Heat generated in CFB combustor produces saturated steam in the heat exchanger.

Radiant boiler 60 is also equipped with a heat exchanger (not shown) containing a heat exchange fluid therein. Heat generated in the radiant boiler produces saturated steam in the heat exchanger.

Heat exchanger fluid line 200 carries saturated steam generated in heat exchanger located in CFB combustion chamber 22, while heat exchanger fluid line 210 carries saturated steam generated in heat exchanger located in radiant boiler 60. The two heat exchanger fluid lines are merged and the saturated steams are mixed from the two sources and are led into primary superheater 90 by way of heat exchanger fluid line 220. The saturated steam is superheated in primary superheater 90 and then is directed by way of supply line 240 to fluid bed heat exchanger 100 (secondary superheater) which may be an integral part of CFB combustor 20 or located externally to the CFB combustor. The superheated steam is led from FBHE 100 to steam turbine by way of supply line 260 for generating electricity by the system.

The process and apparatus schematically described with reference to FIG. 1 for repowering boilers with a circulating fluidized bed combustor does not involve major pressure part modifications to existing boilers. The invention allows the utility companies to continue firing low cost, high sulfur-containing coal or other low grade solid fuels, reduce plant emissions, and comply with the 1990 Clean Air Act requirements in a cost effective manner.

While in FIG. 1 the invention is described with reference to the use of radiant boilers, it is to be understood that the invention contemplates the use of cyclone fired boilers, pulverized coal fired boilers, oil and gas fired boilers which are known in the art for generating steam and electricity. These boilers having features comprising:

a combustion chamber for burning carbonaceous fuel materials therein;

an exit in the combustion chamber for exhausting hot gasses from the combustion chamber;

means for supplying fuel into the combustion chamber;

means for supplying air into the combustion chamber; and heat exchange means in the combustion chamber for cooling the walls of the combustion chamber and for generating steam which is used in the process for generating electric power.

Figure 2:
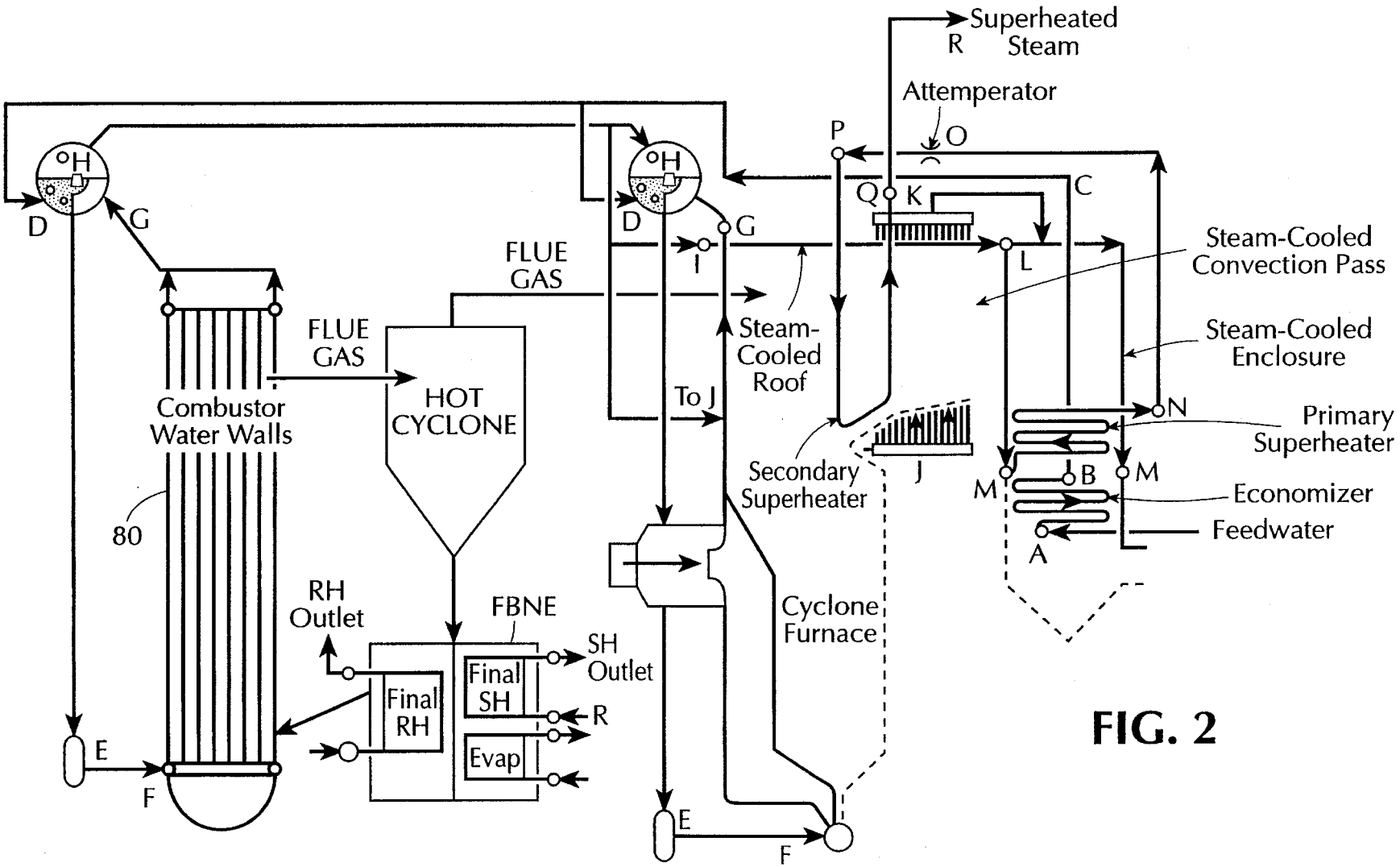
FIG. 2 is a schematic representation of the water/steam circulation system for the circulating fluidized bed/cyclone fired boiler.

Turning now to the description of the water/steam circulation system of the present invention, FIG. 2 schematically shows the water/steam circulation system for CFB/cyclone fired boiler.

Fluidized bed combustion chamber 22 (shown in FIG. 1) is equipped with water walls 80 (heat exchanger I) having finger web configuration to contain water to be heated therein by the combustion of a mixture of coal, air and limestone. Feedwater for water walls 80, as well as for the total system, is provided through inlet A and is carried through lines connecting the points B, C and D. The two-phase circuit, i.e. water and steam is denoted by the lines connecting the points D, E, F, G and H. The steam circuit for the saturated steam is denoted by the lines connecting the points H, I, L, M, N, 0, P, Q and R; while the steam circuit for the superheated steam is denoted by the lines connecting the points H, J, K, M, N, 0, P, Q and R.

Referring now to both FIG. 1 and FIG. 2, saturated steam generated in water walls 80 (heat exchanger I) of combustion chamber 22 is led by way of heat exchanger fluid line 200 to be combined in heat exchanger fluid line 220 with saturated steam generated in the water walls in radiant boiler or furnace 82 (heat exchanger II) led by way of heat exchanger fluid line 210. Heat exchanger fluid line 220 is led into primary superheater 90 located between points M–N where the saturated steam is superheated. From the primary superheater the superheated steam is led by way of supply line 240 to secondary superheater 100 located between points P–Q. From the secondary superheater the superheated steam is led to the turbine to generate electricity.

Figure 3:
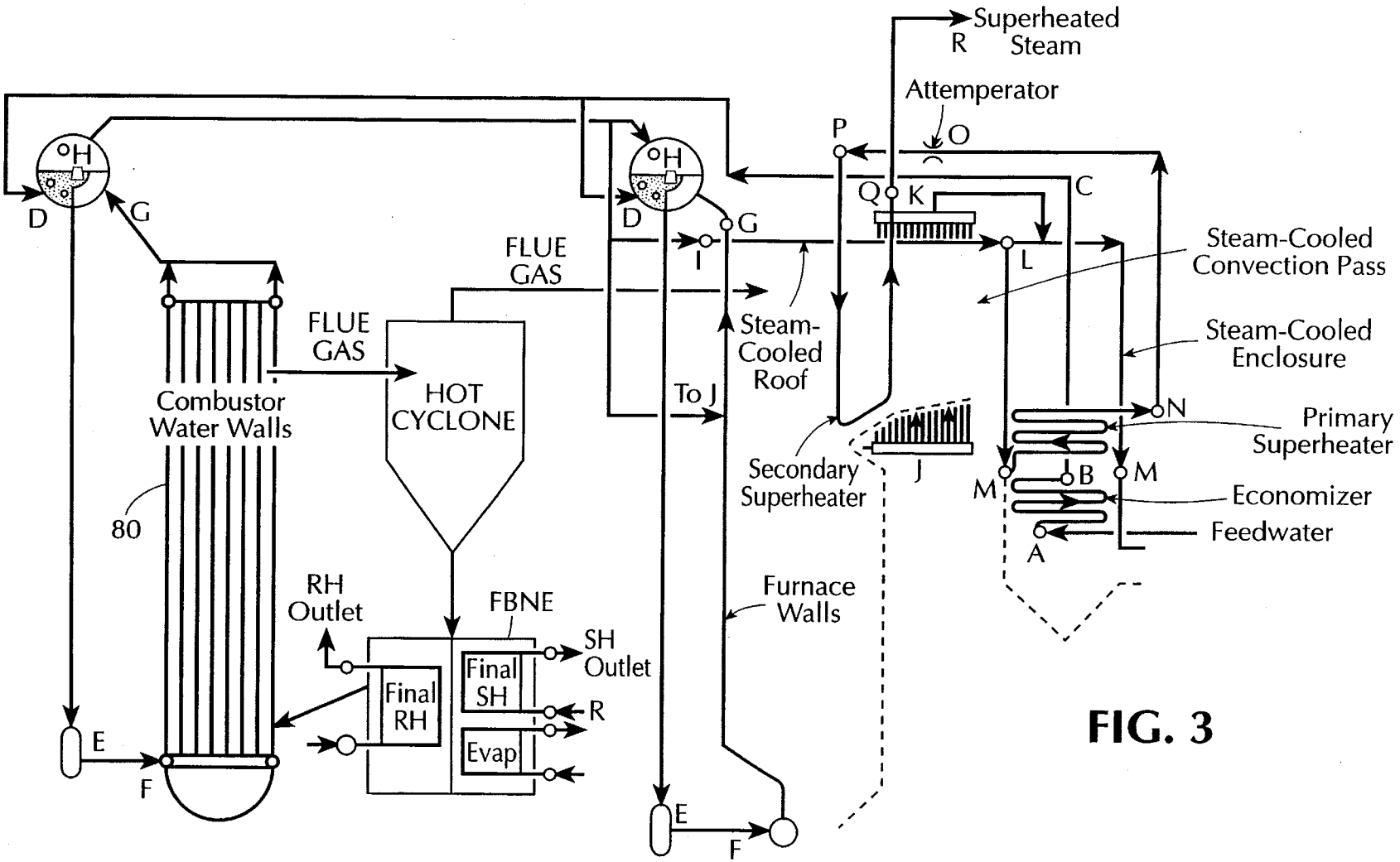
FIG. 3 is a schematic representation of the water/steam circulation system for the circulating fluidized bed/pulverized coal fired boilers or oil and gas fired boilers.

FIG. 3 illustrates the water/steam circulation system for CFB/pulverized coal fired boilers, or oil and gas fired boilers. The system is analogous to that shown in FIG. 2 for the CFB/cyclone fired boiler.

Figure 4:
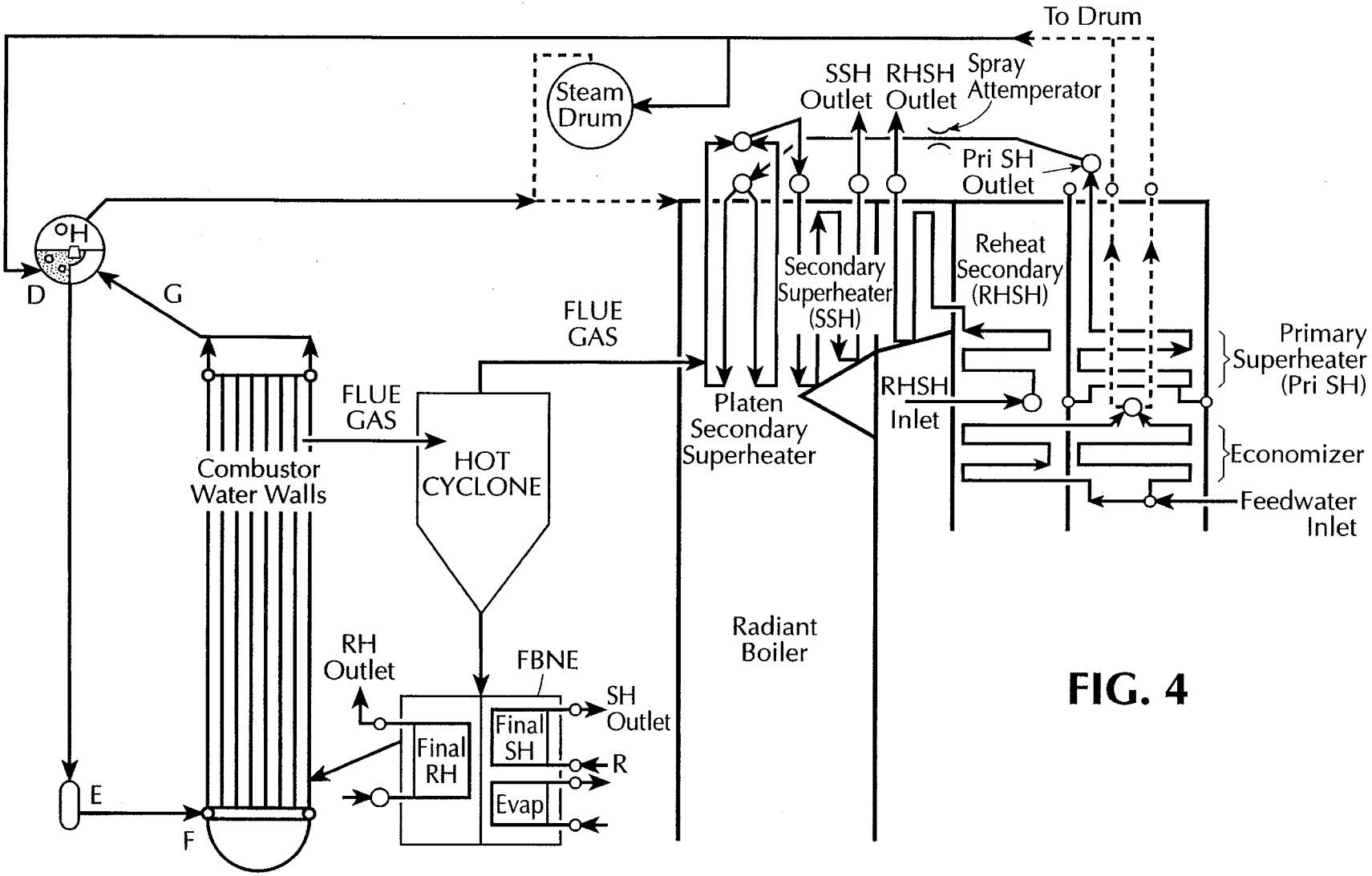
FIG. 4 is a schematic representation of the water/steam circulation system for the circulating fluidized bed/radiant boilers.

FIG. 4 illustrate the water/steam circulation system for the CFB/radiant boiler system. The system is analogous to that shown in FIG. 2 and 3.

The system and the process of the present invention can be used with little hardware changes to repower existing boilers, radiant furnaces that burn various carbonaceous fuels including high sulfur, low grade coals, while greatly reducing industrial pollution comprising SOx and NOx. To illustrate the efficacy of SOx and NOx reduction in cyclone fired boilers the following is provided. If a cyclone fired boiler generates 2.5 lbs/MM BTU SOx emission prior to it being repowered with CFB combustor, the reduction in SOx based on the amount of heat input by CFB is:

| | |
|---|---|
| 100% CFB heat input | 90% $SO_x$ reduction |
| 90% CFB heat input | 81% $SO_x$ reduction |
| 80% CFB heat input | 72% $SO_x$ reduction |
| 70% CFB heat input | 63% $SO_x$ reduction |

NOx reduction in a cyclone fired boiler, which generates 2.0 lbs/MM BTU NOx prior to it being repowered with CFB combustor, based on the amount of heat input by CFB is:

| | |
|---|---|
| 100% CFB heat input | 90% $NO_x$ reduction |
| 70% CFB heat input | 81% $NO_x$ reduction. |

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A system for repowering an industrial or utility boiler with a circulating fluidized bed combustor to reduce SOx and NOx emissions in said boiler, said system comprising:

(a) a circulating fluidized bed combustor comprising: a combustion chamber for combusting a carbonaceous solid fuel therein in admixture with limestone and air at a temperature of from about 1500° F. to 1700° F. to produce heated exhaust gases; and a heat exchanger (I) containing water to produce saturated steam therein by said combustion;

(b) a particulate separator into which the heated exhaust gases containing particulates and flue gases are fed to separate the particulates from the flue gases;

(c) a boiler comprising: a combustion chamber for combusting a carbonaceous fuel and air to generate heat and to produce heated exhaust gases, said boiler combustion chamber to receive the flue gases from said particulate separator to be mixed with the heated exhaust gases in said boiler combustion chamber in amounts so that all of the flue gases from the particulate separator will be mixed with all of the combustion exhaust from said boiler combustion chamber; and a heat exchanger (II) containing water therein to produce saturated steam by said combustion;

(d) controlling means for supplying from about 70 to about 90% heat input from said circulating fluidized bed combustor and from about 30 to about 10% heat input from the boiler;

(e) means for leading the saturated steam produced in the heat exchanger (I) located in said circulating fluidized bed combustor to heat exchanger (II) located in said boiler which contains saturated steam produced therein;

(f) means for leading the saturated steam from heat exchanger (II) to primary superheater located at the inlet header of the boiler furnace;

(g) means to combine saturated steam from heat exchanger (I) with saturated steam from heat exchanger (II) to obtain a mixture of the saturated steam;

(h) a primary superheater to receive the mixed saturated steam to produce a superheated steam therewith;

(i) a secondary superheater located in heat exchanger (I) to receive and further heat the superheated steam from said primary superheater; and (j) means to lead said superheated steam to a steam turbine.

2. The system of claim 1 wherein said particulate separator is a hot cyclone separator.

3. A process for repowering an industrial or utility boiler with a circulating fluidized bed combustor to reduce SOx and NOx emissions from said boiler comprising the steps of:

(a) feeding a carbonaceous solid fuel, air and limestone into a circulating fluidized bed combustor which comprises a combustion chamber and a heat exchanger (I) containing water therein;

(b) firing the low grade solid fuel in the presence of the limestone and operating said circulating fluidized bed at a temperature of about 1600° F. to produce heat and exhaust gases containing solid particulates whereby:

(1) the carbonaceous solid fuel undergoes combustion and the limestone provides for capture of SOx which results from the oxidation of the sulfur;

(2) the low heat release at about 1600° F. results in low thermal NOx; and (3) saturated steam is produced in heat exchanger (I);

(c) separating flue gases from the solid particulate produced in step (b) using a particulate separator;

(d) feeding the solid separated particulates back into the fluidized bed combustor for further combustion and recirculation;

(e) feeding a mixture of a carbonaceous fuel and air into a boiler furnace, said boiler furnace comprising: a combustion chamber and a heat exchanger (II) containing water therein;

(f) burning the mixture to generate exhaust gases in the combustion chamber and to produce saturated steam in heat exchanger (II);

(g) leading flue gases separated from the solid particulates in step (c) into the combustion chamber of the boiler furnace and mixing the flue gases with the exhaust gases generated in the combustion chamber of the boiler furnace to form a mixture of gases comprising: all of the flue gases generated in the circulating fluidized bed combustor; and all of the exhaust gases generated in the combustion chamber of the boiler furnace;

(h) controlling the total heat generation by maintaining the circulating fluidized bed heat input to the boiler furnace at about 70 to 90% and the heat input of the boiler furnace at about 30 to 10%;

(i) leading the saturated steam produced in heat exchanger (I) in step (b) and mixing it with the saturated steam produced in heat exchanger (II) in step (f);

(j) leading the mixed saturated steam into primary superheater located at the inlet header of the boiler furnace to produce a superheated steam;

(k) leading the superheated steam to a secondary superheater or reheater located in heat exchanger (I) which secondary heat exchanger may be an integral part or external component of the circulating fluidized bed combustor;

(l) reheating the superheated steam in the secondary heat exchanger; and (m) leading the superheated steam to an inlet in a steam turbine to provide power for generating electricity.

4. The process of claim 3 wherein said carbonaceous solid fuel in said circulating fluidized bed is a low grade, high sulfur-containing coal.

5. The process of claim 3 wherein said particulate separator is a hot cyclone separator.

6. The process of claim 3 wherein the carbonaceous fuel fed into the boiler furnace is selected from the group consisting of coal, oil and gas.

7. The process of claim 3 wherein said industrial or utility boiler is a cyclone fired boiler.

8. The process of claim 6 wherein said industrial or utility boiler is a radiant boiler.

* * * * *